US006228484B1

(12) United States Patent
Willert-Porada et al.

(10) Patent No.: US 6,228,484 B1
(45) Date of Patent: May 8, 2001

(54) COMPOSITE BODY, ESPECIALLY FOR A CUTTING TOOL

(75) Inventors: Monika Willert-Porada; Thorsten Gerdes, both of Dortmund; Klaus Dreyer, Essen; Klaus Rödiger, Bochum; Udo König, Essen, all of (DE)

(73) Assignee: Widia GmbH, Essen (DE)

( * ) Notice: Subject to any disclaimer, the term of this patent is extended or adjusted under 35 U.S.C. 154(b) by 0 days.

(21) Appl. No.: 09/320,517

(22) Filed: May 26, 1999

(51) Int. Cl.[7] ..... B32B 9/00

(52) U.S. Cl. ..... 428/336; 51/307; 51/309; 75/238; 75/239; 75/242; 75/244; 428/469; 428/698

(58) Field of Search ..... 75/238, 242, 239, 75/244; 51/307, 309; 428/698, 336, 469

(56) References Cited

U.S. PATENT DOCUMENTS

| | | | | |
|---|---|---|---|---|
| 4,095,978 | * | 6/1978 | Kieffer | 75/238 |
| 4,728,579 | * | 3/1988 | Konig | 428/698 |
| 4,758,451 | * | 7/1988 | Van Den Berg et al. | 427/255.2 |
| 4,935,057 | * | 6/1990 | Yoshimura et al. | 75/238 |
| 4,944,800 | * | 7/1990 | Kolaska | 75/238 |
| 4,985,070 | * | 1/1991 | Kitamura et al. | 75/239 |
| 5,041,261 | * | 8/1991 | Buljan et al. | 75/238 |
| 5,053,074 | * | 10/1991 | Buljan et al. | 75/236 |
| 5,089,047 | * | 2/1992 | Buljan et al. | 75/238 |
| 5,223,020 | * | 6/1993 | Kolaska | 75/238 |
| 5,330,553 | * | 7/1994 | Weinl et al. | 75/238 |
| 5,397,530 | * | 3/1995 | Narasimhan et al. | 419/1 |
| 5,462,901 | * | 10/1995 | Egami et al. | 75/242 |

FOREIGN PATENT DOCUMENTS

| | | |
|---|---|---|
| 38 06 602 | 4/1991 | (DE) . |
| 43 40 652 | 6/1995 | (DE) . |
| 196 01 234 | 7/1997 | (DE) . |

OTHER PUBLICATIONS

"Einsatz von Mikrowellen Zum Sintern Pulvermetallurgisher Produkte" (Teil 2), Willert–Porada et al, Metall,51 Jahrgang,Nr.Nov., 1996, 9 pages.

"Hard Sintered Alloy Having Gradient Compositional Structure . . . " C– 997, Oct. 21, 1992 vol. 16/No.509, 1 page.

* cited by examiner

*Primary Examiner*—Archene Turner
(74) *Attorney, Agent, or Firm*—Herbert Dubno

(57) ABSTRACT

A composite body of a microwave sintered composition of a cermet or hard metal as a modified surface layer which can promote the microwave sintering and can be of a thickness of 0.01 to 1 mm with a density gradually decreasingly inwardly or a thickness up to 1 mm and having locally distributed compacts therein or which can be a layer of a thickness of 1 to 10 mm of a substantially pure metal or which can have a binder metal removed to a depth of about half the grain thickness of a hard material such as WC.

20 Claims, 4 Drawing Sheets

COMPOSITE BODY, ESPECIALLY FOR A CUTTING TOOL

FIELD OF THE INVENTION

The present invention relates to a composite body, and more particularly, to a composite body which comprises a hard material phase, for example, a cermet or hard metal, in a binder metal phase for use in or as a cutting tool, for example, as a so-called cutting insert for a milling cutter, a turning machine (lathe) or the like.

The invention relates in particular to cermet and hard metal composites which are formed by sintering in a microwave field.

BACKGROUND OF THE INVENTION

The formation of wear resistant composites which are hard enough to function as cutting tools or which can be coated with wear resistant materials so as to function as cutting tools is known. Reference may be had, for example, to Japanese Patent Document 4-187739 published Jul. 6, 1992 and described in Patent Abstracts of Japan C-997, Oct. 21, 1992, Vol. 16, No. 509, DE 43 40 652 A1, DE 38 06 602 C2, DE 196 01 234 A1. The principle of microwave sintering as used for such composites is described in WO 96/33830.

OBJECTS OF THE INVENTION

It is the principal object of the present invention to provide an improved composite body, especially for use as a cutting tool, e.g. as a cutting insert for a milling cutter, whereby drawbacks of earlier composite material are avoided.

Another object of this invention is to provide a composite body of the class mentioned previously which has improved properties, inter alia as far as the field strength of the microwave field during sintering is concerned.

Yet another object of this invention is to provide a composite body with an improved surface modification.

SUMMARY OF THE INVENTION

According to one aspect of the invention, a composite body can be composed essentially of a microwave-sintered composition of a cermet composed of 0 to 30 mass-percent of a binder metal phase and the balance a carbonitride phase or a hard metal composed of 70 to 100% of a hard material phase and the balance of a binder metal phase; and a layer on a surface of the composition and bonded to the composition, of a thickness of 0.01 to 1 mm and having a density gradually decreasing from 100% of theoretical density at an outer face of the layer to about 60% of theoretical density inwardly of the outer face.

The thickness of the layer is preferably 0.5 to 1 mm.

This composite body which can be used especially as a cutter for high speed milling can thus have a hard dense surface with a porous core and as a result can be 40% lighter than the usual cutting insert for such a milling cutter. As a consequence, the centrifugal force generated when the cutter is rotated can be minimized and hence the strain on the cutter can be reduced in machining applications. The body also has the advantage that it can be removed or partly ground away and then infiltrated by a further material as, for example, silver if the body is to be used as an electrical contact material. When the body is employed as a wear protecting structure it has the advantage of reduced thermal conductivity and thus can be used to protect structures against overheating.

Alternatively, the composite body can be composed essentially of a microwave-sintered composition of a cermet composed of 0 to 30 mass-percent of a binder metal phase and the balance a carbonitride phase or a hard metal composed of 70 to 100% of a hard material phase and the balance of a binder metal phase; and a layer on a surface of the composition and bonded to the composition, of a thickness up to 1 mm and having compacts distributed locally therein of diameters of 30 to 50 $\mu$m.

In this case, the layer or coating on the composite compression, with a thickness up to 1 mm, has local dense regions of compacts with diameters of 30 $\mu$m to 50 $\mu$m and hence locally harder regions at the surface. This system has the advantage also of a reduction in weight because of the higher porosity in the less dense regions and the body can be utilized with advantage as a cutter or as a cutting insert for a milling cutter in high speed milling, as an electrical contact component when impregnated with silver, for example, and as a wear protecting body.

In still another aspect of the invention, the composite body is composed essentially of a microwaresintered composition of a cermet composed of 0 to 30 mass-percent of a binder metal phase and the balance a carbonitride phase or a hard metal composed of 70 to 100% of a hard material phase and the balance of a binder metal phase; and a layer on a surface of the composition and bonded to the composition, of a thickness of 1 to 10 $\mu$m, of a substantially pure metal capable of increasing field strength during microwave sintering.

This thickness can be 1 to 3 $\mu$m and the layer can be composed of a metal of the hard material phase, for example, tungsten. With a pure metal from the hard material phase or a number of pure metals from this phase, and especially tungsten, the body has a high degree of wear resistance and can be used effectively for the purposes described.

In a fourth alternative, the composite body can comprise:

a microwave-sintered composition of a cermet composed of 0 to 30 mass-percent of a binder metal phase and the balance a carbonitride phase or a hard metal composed of 70 to 100% of a hard material phase and the balance of a binder metal phase; and a layer in which a binder metal or one of the binder metal phases is removed from a surface of the composition in a thickness or to a depth up to half a mean grain size of a carbonitride or hard material phase (WC) so that within the thickness or depth only a hard material skeleton is formed to enhance a field strength during microwave sintering.

This thickness, in particular, can be up to half the mean grain size of tungsten carbide in the composition.

The cermet can have a carbonitride phase of Ti, Zr, Hf, V, Nb, Ta, Cr, Mo and/or W and a binder metal phase of Co and/or Ni. The hard metal phase can be an oxycarbide, oxynitride, oxycarbonitride or boride of one of these elements. Preferably the hard metal composition of the invention comprises hexagonal WC as a first phase and a cubic carbide of a mixed crystal of W, Ti, Ta and/or Nb as a second phase with a binder metal phase of Co, Ni, Fe or mixtures thereof. The hard metal can be especially composed of hexagonal mixed carbides of WC with MoC and/or cubic mixed carbides of the elements Ti, Zr, Hf, V, Nb, Ta, Cr, Mo and/or W and a binder metal phase of Co and/or Ni.

The binder metal phase can have up to 10 mass % of one of the metals Mo, W, Ti, Mn and/or Al (with respect to the total mass of the binder metal phase).

Preferably the binder metal phase is composed of an Ni/Al alloy with an Ni/Al weight ratio of 90:10 to 70:3. The binder metal phase can, in addition, contain up to 1 mass % boron (calculated based upon the total mass of the binder metal phase).

The binder metal phase can also be composed of $Ni_3Al$, $TiSi_3$, $Ti_2Si_3$, $Ti_3Al$, $Ti_5Si_3$, TiAl, $Ni_2TiAl$, $TiSi_2$, NiSi, $MoSi_2$, or mixtures thereof. In addition, the binder metal phase can contain 0 to 16 mass % cobalt, nickel, iron and/or rare earth metals.

Alternatively, the binder metal phase can be composed of nickel and chromium with additions of molybdenum, maganese, aluminum, silicon and copper in amounts of 0.01 to 5 mass %.

According to a further feature of the invention, the composite body can be provided with one or more surface layers which can be applied by plasma vapor deposition (PVD), chemical vapor deposition (CVD) or plasma assisted chemical vapor deposition (PCVD), preferably in a microwave field. The composition basically can be that of WO 96/33830 with, however, the surface modifications of the invention so that the advantages, features and uses of the compositions described in that document can apply here as well.

When cutter or tool inserts of the composite body of the invention are produced from tungsten carbide with cobalt as a binder, the pulverulent cobalt can be mixed in an amount of six weight % with 1.5 weight % of wax as a plastifier and the balance WC to form a green body. The green body is placed in an isolating box of an $Al_2O_3$ fiber ceramic or thin $Al_2O_3$ rods and subjected to microwave sintering in a cylindrical microwave apparatus with shiftable walls and whose volume can be varied between 80 to 120 liters. The starting microwave power was 500W. Over 50 minutes the temperature rose to 450° C. at the charge. Depending upon the temperatures generated, the rate of temperature increase, the duration for which the body was held at each temperature and the cooling conditions, different composite bodies were obtained with properties elucidated in connection with the accompanied drawing.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
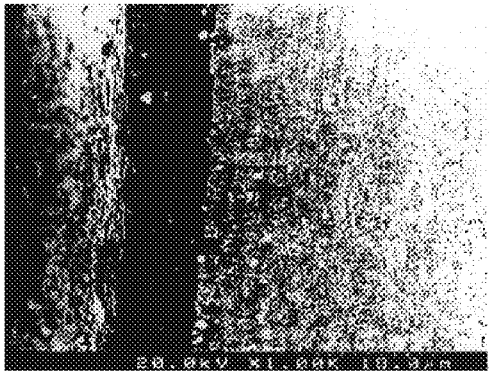
FIG. 1 is a microphotograph of a microwave sintered WC 6 Co hard metal with a boundary layer in the region of the surface.

When a pressed body is to be microwave sintered with increased field strengths, it is possible to use a surface treatment to bring about the increased field strength. Unlike conventional sintering, in which boundary layers like those of microwave sintering are not formed at the surfaces, FIG. 1 shows that with microwave sintering at a temperature of even about 1000° C., the microwave radiation can contribute to a typical local compaction. Such local compaction is simply not observed with conventional sintering.

Figure 2:
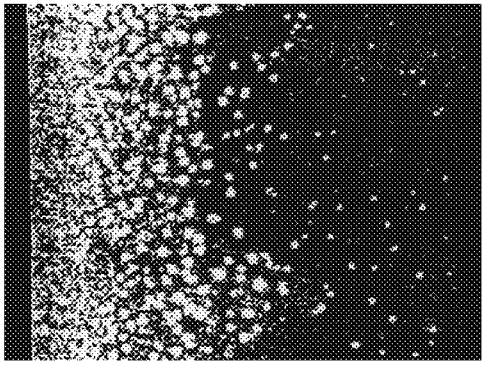
FIG. 2 is a photomicrograph of a WC hard metal with a boundary zone compaction in an earlier state of sintering.

The specimen shown in FIG. 2 illustrates the boundary region (left side) with its greater density, here visible as a clearer region. The hard metal body is initially heated to 450° C. and in the course of the next forty minutes is subjected to enhanced microwave power of 2500 watts in 8 stages until the charge temperature reaches 1100° C. The treatment is effected in an Ar atmosphere with 5 volume % $H_2$. After reaching the charging temperature of 1100° C., this temperature is maintained for 30 minutes before the furnace is cooled over 2.5 hours to room temperature. The cutting inserts are provided with a dense boundary layer along the external surfaces with a thickness of 1000 $\mu$m. In the interior regions, the specimen has a density of about 60% of the theoretical density.

Figure 3:
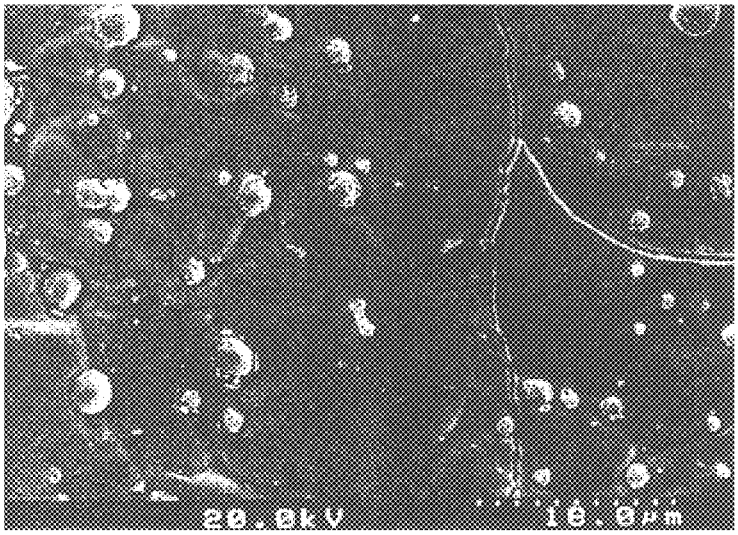
FIG. 3 is a microphotograph of a WC 6 Co sintered surface.

FIG. 3 shows that hard metals sintered at moderate field strengths instead of high field strengths, because of the differences in thermal coefficients of expansion between the surface layer and the interior of the hard metal, can give rise to crack formation in the surface. In order to obtain a layer in the region of the surface with local compact zones, the body is subjected to heating to 450° C. in the course of 40 minutes stepwise with progressively higher microwave powers. The microwave power is increased in eight equal steps to 2500 watts until the charge temperature reaches 1100° C. The heat treatment is effected in an argon atmosphere with five volume % $H_2$. After reaching the temperature of 1100° C., the furnace is immediately subjected to cooling until it reaches room temperature in 2.5 hours. The cutting inserts thus obtained have a 1000 $\mu$m thick boundary layer.

Figure 4:
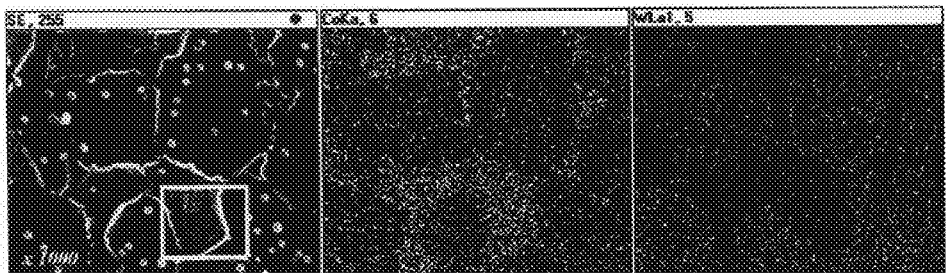
FIG. 4 is a series of microphotographs of a WC 6 Co sintered surface produced with higher field strengths and with corresponding tungsten and cobalt distributions (EDX)
Figure 5:
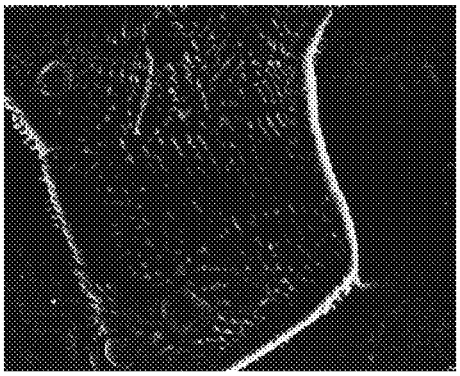
FIG. 5 is a microphotograph in an enlarged scale of a region from the microphotograph of FIG. 4.
Figure 6:
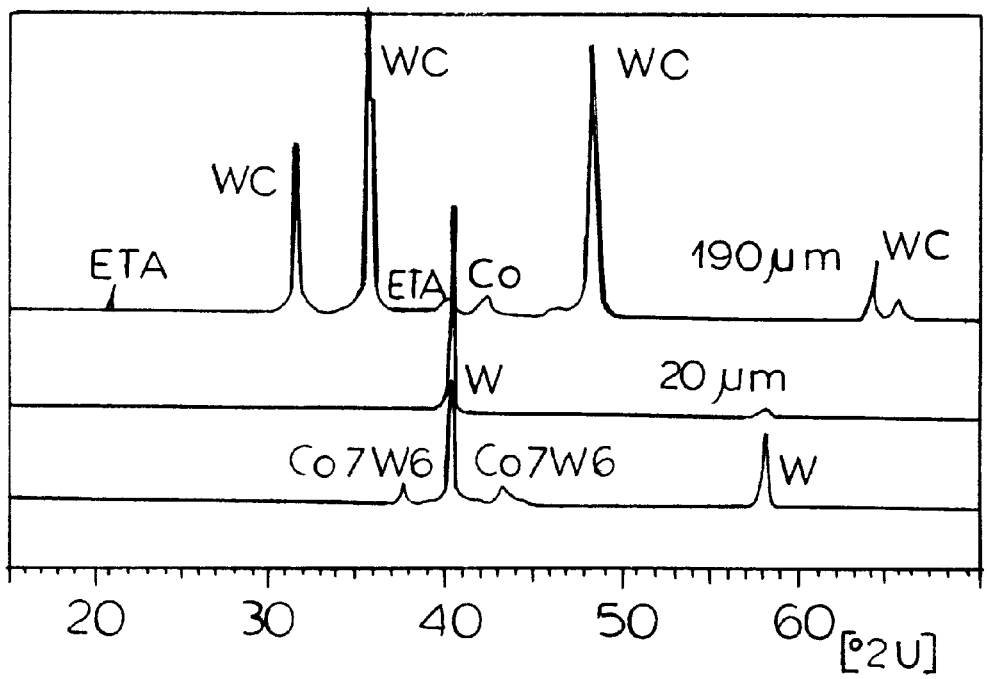
FIG. 6 is an x-ray defraction pattern of a microwave sintered WC 6 Co surface.

The individual layers of about 40 $\mu$m in size are practically fully compacted as has been indicated in FIG. 4. In order to increase the field strength during the microwave sintering, a layer is applied to the surface of the body which can consist of pure metal of the hard metal phase, especially pure tungsten and can be applied in an inert atmosphere of argon (up to 350° C.) and then subjected to treatment with an argon-hydrogen atmosphere with a five volume % hydrogen content. The heating rate amounts to 0.1 to a maximum of 3° C. per minute until 350° C. is reached. After reaching 350° C., the heating rate is increased stepwise, namely at 15° C. per minute to 1000° C. and at 50° C. per minute between 1000° C. and 1250° C. After reaching the temperature over 50° C., the power is raised by 50%. After a retention time of 10 minutes, the microwave power is shut off and furnace cooling is undertaken in about 3 hours. The results are sintered bodies, e.g. cutting plates or inserts for a lathe which have boundary layers of about 20 $\mu$m in thickness and which in the surface regions are comprised of tungsten layers with a thickness of about 5 $\mu$m (see FIG. 6).

Such boundary layers have a variety of uses for composite bodies. For example, applied diamond coatings adhere much better to such surfaces and any adhering coating has a greater life. However, even uncoated cutting inserts with tungsten enrichment at the surface or boundary layers have proved to be useful, for example, in the machining of aluminum since a binder metal, like cobalt, no longer must come into direct contact with the aluminum. Metallization of this type in the surface layers can be used to increase corrosion resistance and improve the ability of the surface to be wetted by a solder.

Figure 8:
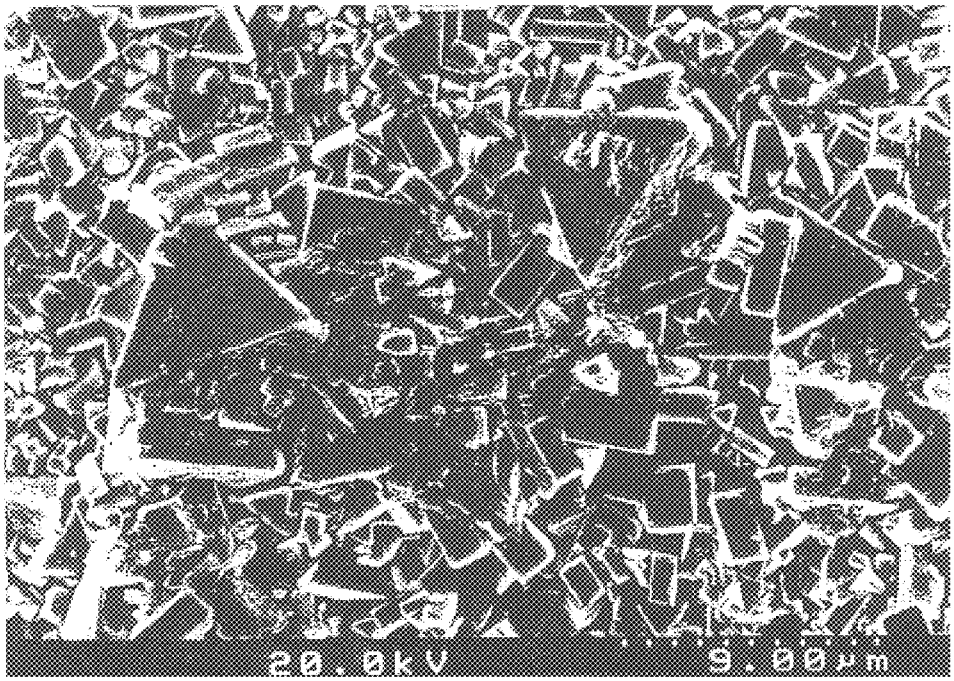
FIG. 8 is a microphotograph of a hard metal surface etched in situ.
Figure 7:
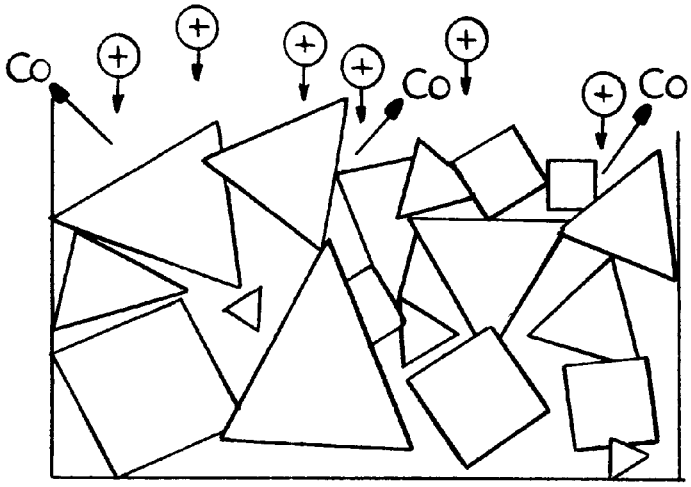
FIG. 7 is a diagram of the mechanism of self sputtering resulting from the plasma ignition during hard metal sintering.

If, in the aforedescribed process, after the temperature reaches 1250° C. the power is so increased that a plasma is ignited and this higher microwave power is maintained at 1250° C. for 10 minutes and then the furnace is cooled over a period of three hours to room temperature, one obtains a cutting insert which has a boundary layer or coating on the hard material or cermet body or composition with a thickness of about 10 μm which in the region of the surface, consists of about a 1.5 μm thick film of binder metal free tungsten carbide. It appears that this is a result of complete evaporation of the binder metal phase at the surface so that in the region adjacent the surface or the boundary zone with this region from which the binder metal has evaporated there is only a skeleton of WC grains while the interior of the structure has a normal density. The mechanism of the self sputtering by the plasma has been schematically illustrated in FIG. 7. FIG. 8 shows a surface region of a WC-CO sample whose surface has been etched in situ by the plasma. Such a boundary layer modification improves the adhesion of coatings which can be applied by means of a PVD or CVD process. This applies for diamond coatings, aluminum oxide coatings and solid lubricant coatings (such as molybdenum disulfide) and insures improved trapping of the coating material in the roughened surface of the substrate body. The aforedescribed effect cannot be achieved by a material exchange of the sintered body with the sintering atmosphere nor by a uniform microwave heating of the surface zones. Isolated compacted regions distributed locally over the surface appear to develop in the case of locally effective arcs or plasmas. The higher field strength which arises in such cases appears to generate a tendency to greater microwave absorption and thus a more effective microwave heating although the plasmas and arcs can drastically reduce the penetration depth of energy into the body. The local field strength increases are found to vary greatly over the surface regions and the various effects which can be produced can include segregation processes which contribute to large area separations of tungsten-rich or cobalt-rich phases, a reduction of tungsten carbide at the surface to tungsten (FIG. 6) and the like. Only about 50 μm beneath the surface of the body is the typical fiber composition detectable. Finally, mention should be made of the fact that ignited plasmas can also be used to achieve binder metal evaporation at the surfaces to yield a correspondingly roughened face of the body (see FIG. 8).

In general, therefore, the normal composite structure can be subjected to a plasma or a plasma coating process in the manner described above to densify a layer at the surface to a density of 100% of theoretical density, diminishing inwardly to 60% of the theoretical density and with a depth of 0.5 to 1 mm by the application of an additional coating from the gas phase or by surface modification of the composite, or to provide a layer in a thickness up to 1 mm containing local compact zones with diameters of 30 to 50 μm, and zones which are of limited thickness and consist of pure tungsten for example to a depth of 1 to 3 μm or which have a binder metal phase evaporated to the depth of about half the means grain size as has been described.

We claim:

1. A microwave-sintered composite body made by sintering in a microwave field and composed essentially of:

a cermet composed of 0 to 30 mass-percent of a binder metal phase and the balance a carbonitride phase or a hard metal composed of 70 to 100% of a hard material phase and the balance of a binder metal phase and having a surface layer composed of the cermet or hard metal of a thickness of 0.01 to 1 mm and having a density gradually decreasing from 100% of theoretical density at an outer face of said layer to about 60% of theoretical density inwardly of said outer face.

2. The composite body defined in claim 1 wherein said thickness is 0.5 to 1 mm.

3. A composite body made by sintering in a microwave field and composed essentially of:

a cermet composed of 0 to 30 mass-percent of a binder metal phase and the balance a carbonitride phase or a hard metal composed of 70 to 100% of a hard material phase and the balance of a binder metal phase and having a surface layer composed of the cermet or hard metal of a thickness up to 1 mm and having compacts distributed locally therein of diameters of 30 to 50 μm.

4. A composite body made by sintering in a microwave field and composed essentially of:

a cermet composed of 0 to 30 mass-percent of a binder metal phase and the balance a carbonitride phase or a hard metal composed of 70 to 100% of a hard material phase and the balance of a binder metal phase and having a surface layer composed of the cermet or hard metal of a thickness of 1 to 10 μm, of a substantially pure metal capable of increasing field strength during microwave sintering.

5. The composite body defined in claim 4 wherein said thickness is 1 to 3 μm, and said layer is composed of a metal of said hard material phase.

6. The composite body defined in claim 5 wherein said pure metal is tungsten.

7. A microwave sintered composite body consisting essentially of:

a cermet composed of 0 to 30 mass-percent of a binder metal phase and the balance a carbonitride phase or a hard metal composed of 70 to 100% of a hard material phase and the balance of a binder metal phase and having a surface layer composed of the cermet or hard metal from which binder metal of one of said binder metal phases is evaporated to a depth up to half a mean grain size the carbonitride or hard material phase so that up to said thickness only a hard material skeleton is formed to enhance field strength during microwave sintering.

8. The composite body defined in claim 7 wherein said thickness is up to half of the mean grain size of tungsten carbide in said body.

9. The composite body defined in claim 1, claim 3, claim 4 or claim 7 wherein said cermet has a carbonitride phase of at least one of the metals selected from the group consisting of Ti, Zr, Hf, V, Nb, Ta, Cr, Mo and W, and a binder metal phase of at least one metal selected from group which consists of Co and Ni.

10. The composite body defined in claim 1, claim 3, claim 4 or claim 7 wherein said hard material phase is at least one substance selected from the group which consists of oxycarbides, oxynitrides, oxycarbonitrides and borides.

11. The composite body defined in claim 1, claim 3, claim 4 or claim 7 wherein said hard metal comprises hexagonal WC as a first phase and a cubic carbide of at least one metal selected from the group which consists of W, Ti, Ta and Nb as a second phase, and a binder metal phase of at least one metal selected from the group which consists of Co, Ni and Fe.

12. The composite body defined in claim 1, claim 3, claim 4 or claim 7 wherein said hard metal is a hexagonal mixed carbide of WC with at least one of the compounds MoC and cubic mixed carbides of at least one element selected from the group which consists of Ti, Zr, Hf, V, Nb, Ta, Cr, No and W, with a binder metal phase of at least one metal selected from the group which consists of Co, Fe and Ni.

13. The composite body defined in claim 1, claim 3, claim 4 or claim 7 wherein said binder metal phase contains up to 15 mass-percent of the total mass of the binder metal phase of at least one element selected from the group which consists of Mo, W, Ti, Mn and Al.

14. The composite body defined in claim 13 wherein said binder metal phase is an Ni-Al alloy with an Ni/Al weight ratio of 90:10 to 70:30.

15. The composite body defined in claim 14 wherein said binder metal phase contains up to 1 mass-percent of the total binder metal phase of boron.

16. The composite body defined in claim 1, claim 3, claim 4 or claim 7 wherein said binder metal phase is selected from the group which consists of $Ni_3Al$, $TiSi_3$, $Ti_2Si_3$, $Ti_5Si_3$, TiAl, $Ni_2TiAl$, $TiSi_2$, NiSi.

17. The composite body defined in claim 16 wherein said body contains up to 16 mass-percent of at least one of the following: Co, Ni, Fe and a rare-earth metal.

18. The composite body defined in claim 1, claim 3, claim 4 or claim 7 wherein said binder metal phase is composed of Ni and Cr.

19. The composite body defined in claim 18 wherein composition contains 0.01 to 5 mass percent of Mo, Mn, Al, Si and Cu.

20. The composite body defined in claim 1, claim 3, claim 4 or claim 7 wherein said layer is a layer deposited by at least one of the processes: PVD, CVD and PCVD, in a microwave field.

* * * * *